US005641118A

United States Patent [19]

Benham

[11] Patent Number: 5,641,118

[45] Date of Patent: Jun. 24, 1997

[54] PACKAGE WITH IMPROVED REMOVABLE STRIP

[75] Inventor: Albert A. Benham, Tuscaloosa, Ala.

[73] Assignee: Gulf States Paper Corporation, Tuscaloosa, Ala.

[21] Appl. No.: 503,861

[22] Filed: Jul. 18, 1995

[51] Int. Cl.[6] ..... B65D 5/54

[52] U.S. Cl. ..... 229/125.35; 229/207; 229/227; 229/903; 229/906

[58] Field of Search ..... 229/125.35, 207, 229/227, 240, 902, 903, 906

[56] References Cited

U.S. PATENT DOCUMENTS

| | | | |
|---|---|---|---|
| 2,608,341 | 8/1952 | Eckman | 229/207 |
| 3,096,918 | 7/1963 | Van Dyke et al. | 229/227 |
| 3,270,946 | 9/1966 | Redpath et al. | 229/207 |
| 3,410,476 | 11/1968 | Buttery | 229/207 |
| 4,046,313 | 9/1977 | Perry | 229/227 |
| 4,386,705 | 6/1983 | Meuller | 229/207 |
| 4,531,668 | 7/1985 | Forbes, Jr. | 229/125.35 |
| 5,078,273 | 1/1992 | Kuchenbecker | 229/207 |
| 5,090,615 | 2/1992 | Murakami et al. . | |
| 5,183,201 | 2/1993 | Gulliver . | |
| 5,217,159 | 6/1993 | Calvert et al. . | |
| 5,330,099 | 7/1994 | Beales et al. | 229/207 |
| 5,402,931 | 4/1995 | Gulliver et al. . | |

*Primary Examiner*—Gary E. Elkins
*Attorney, Agent, or Firm*—Cushman Darby & Cushman IP Group of Pillsbury Madison & Sutro LLP

[57] ABSTRACT

A package for containing solids and other consumable contents is provided that includes a tray having walls and a bottom panel defining a container space and a tray cover having a lid wall panel that encloses the container space. The package thus closed effects a storage container for the contents. The tray cover is constructed of a foldable sheet material. The tray cover includes flap panels that are foldable about flap fold lines over a side of the tray. A removable strip portion and lid separation cuts are provided to facilitate separation of a substantial portion of the lid wall panel from the tray to allow consuming access to the contents. The removable strip portion is defined by interior and exterior partial cuts scored into the tray cover including a plurality of aligned interrupted exterior cuts that are disposed for an extent coincidentally with the flap fold lines. The removable strip portion thus constructed helps ensure folding of the flap panel about the intended fold line while maintaining the strength and integrity of the folded edge.

22 Claims, 9 Drawing Sheets

PACKAGE WITH IMPROVED REMOVABLE STRIP

BACKGROUND OF THE INVENTION

1. Field of the Invention

This invention relates to a carton-type package and particularly to a carton-type package which includes a tray suitable to retain consumable contents therein so that the contents can be (1) heated in an oven while retained therein and (2) thereafter consumed while retained therein, and a tray cover having removable portions that facilitate removal of a lid portion of the tray cover to provide access to the consumable contents.

2. Description of the Related Art

Conventional openers, usually disposed along narrow flaps on conventional carton-type packages, typically involve the provision of zipper type cuts in combination with other features. Usually, however, when a zipper cut is used, it consists of a first and second lines of 100% through cuts running parallel to each other along the long dimension of a flap. Each line of cuts consists of a series of spaced angular cuts. Each angular cut consists of two legs spaced apart by an angle which is less than 180° and greater than 90°. Each angular cut is arranged so that one leg of each angular cut is aligned with corresponding legs of the other angular cuts. The remaining legs of the angular cuts extend angularly in a parallel relation or direction toward the other line of angular cuts.

When the flap is narrow and is attached to a panel along a fold line, there may not be room for two lines of zipper cuts, a fold line, and extra paperboard at the outside edge for gluing the flap in place. For this reason, one line of the zipper cuts is often used as a fold line. When a line of zipper is used as a fold line, however, the zipper cuts themselves are weakened and present an unattractive appearance.

When the flap is folded, usually mechanically, it will generally fold at the weakest fold line. Consequently, it is not practical to have a line of zipper cuts in close parallel relation with a fold line because of the tendency of the fold to occur along the adjacent line of zipper cuts rather than the intended fold line. Moreover, even where one line of zipper cuts is used as a fold line, the close proximity of the other line of zipper cuts presents a situation where the fold could be effected on either line of zipper cuts or both unless extra time consuming care is taken in the process.

Zipper cuts also have the effect of limiting the space available for printed matter on a flap. This effect is worsened when a fold is made along a line of zipper cuts.

Conventional zipper type carton openers, because they are formed by 100% through cuts, have a number of other disadvantages, including:

1. If a flap is folded about a line of zipper cuts, there is a chance of product contamination through gaps in the fold line;
2. There is a chance of product leaking or wicking through the fold line;
3. There is a chance that board rupture will occur along the fold line; and
4. Upon removal of the zipper from the flap, a messy appearance is presented because of the amount of delamination that takes place.

Furthermore, because zipper cuts include an opposite line of zipper cuts opposing the line of zipper cuts defining the fold line, other disadvantages result which include:

1. A printing surface that is marred by the cuts defining the zipper; and

2. An additional weak line on the flap which might inadvertently fold in the machine process rather than the intended fold line.

In addition, zipper type opening features are usually uni-directional which allows removal in only one direction. Also, because of the shape of the cuts and their depth through the board, the plane of the board is disrupted, sometimes permitting the cut edges to be caught and torn during the machining process.

Because a zipper is removed by a tearing process rather than a delamination process, there is a great likelihood of creating small paperboard pieces which could contaminate the product. This same feature also creates a less attractive appearance when the package is opened.

SUMMARY OF THE INVENTION

It is an object of the present invention to avoid the disadvantages expressed above. In accordance with the principles of the present invention, this objective is obtained by providing a package suitable for retaining contents therein. The package comprises a tray having container space defined by a plurality of side wall panels and a bottom wall panel, wherein the contents are contained, and a tray cover constructed of a foldable sheet material having exterior and interior surfaces defining a thickness therebetween constructed and arranged to provide a covering for the tray. The sheet material is constructed and arranged to delaminate along delamination surfaces generally parallel with the exterior and interior surfaces. The tray cover comprises a lid wall panel constructed and arranged so that in a closed position with respect to the tray the lid wall panel encloses the container space and a flap panel integral with the lid wall panel that is folded along a flap fold line over one side wall panel of the tray, the flap fold line comprising a channel scored into the foldable sheet material. The tray cover provides a removable strip portion that is removed to facilitate separation of a substantial portion of the lid wall panel from the tray, the removable strip portion being defined on an exterior surface thereof by exterior score patterns and on an interior surface thereof by interior score patterns. The removable strip portion is constructed and arranged to be removable by manually grasping a grippable end thereof and pulling the removable strip portion away from the tray cover to progressively delaminate the sheet material between the interior score pattern and the exterior score pattern along a predetermined removal path including an extent thereof adjacent the flap fold line. The interior score pattern includes continuous interior cut lines partially penetrating the thickness from the interior surface and disposed in a closely spaced generally parallel arrangement. The interior score pattern extends along the predetermined removal path to insure that delamination occurs along the predetermined removal path. The exterior score pattern includes exterior cuts partially penetrating the thickness from the exterior surface and extending along the predetermined removal path to insure that delamination occurs along the predetermined removal path, the exterior cuts including a plurality of aligned interrupted cuts disposed within the channel along at least a portion of the flap fold line to insure that the integrity of the exterior surface at the fold line is retained and to insure that the flap panel is folded about the flap fold line.

In one embodiment of the present invention, the removable strip portion consists of four partial cut lines running parallel to each other along the long dimension of a narrow flap. One of the partial cuts is the fold line for the flap, cut from the printed side (i.e. the exterior surface) of the paperboard. It is a perforation cut penetrating 50% into the paperboard. This cut is made in a conventional make-ready channel which also creates a round score. The next two partial cuts are made from the backside (i.e. the interior surface) of the paperboard and are set to cut 50% through the paperboard. The last partial cut is made from the exterior surface of the paperboard and is also cut 50% through the material.

With the fold line made up of a 50% perforation cut in a channel rather than a zipper cut 100% through the board, several advantages result, including:

1. There is less chance of product contamination through gaps in the fold line;
2. There is less chance of product leaking or wicking through the fold line;
3. There is less chance that board rupture will occur along the fold line; and
4. Less delamination takes place which presents a neater appearance.

Because there is no opposite zipper cut opposing the fold line's zipper cut, other advantages result which include:

1. A clean printing surface not marred by the zipper cuts; and
2. No weak line which might fold in the machine process rather than the intended fold line.

Moreover, the removable strip portions of the packages of the present invention can be designed to run in a direction convenient to the consumer. Because the opener is not unidirectional, a grippable portion could be placed on both ends of the removable strip portion, accommodating both left and right handed consumers.

Advantages are also shown when the carton is sealed closed. Because the outermost partial cut line of the opener is on the outside surface of the paperboard, it is not affected by the adhesive or sealing on the backside surface. This can permit a larger target area for glue or a narrower flap. In fact, the opener performs better if the flap is sealed under this partial cut line.

Because the opening of the carton is caused by a delamination process rather than a tearing process, there is less likelihood of creating small paperboard pieces which could contaminate the product. This same feature also creates a more attractive appearance when the package is opened.

Other objects, features, and characteristics of the present invention will become more apparent upon consideration of the following description and in the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENTS

Figure 1A:
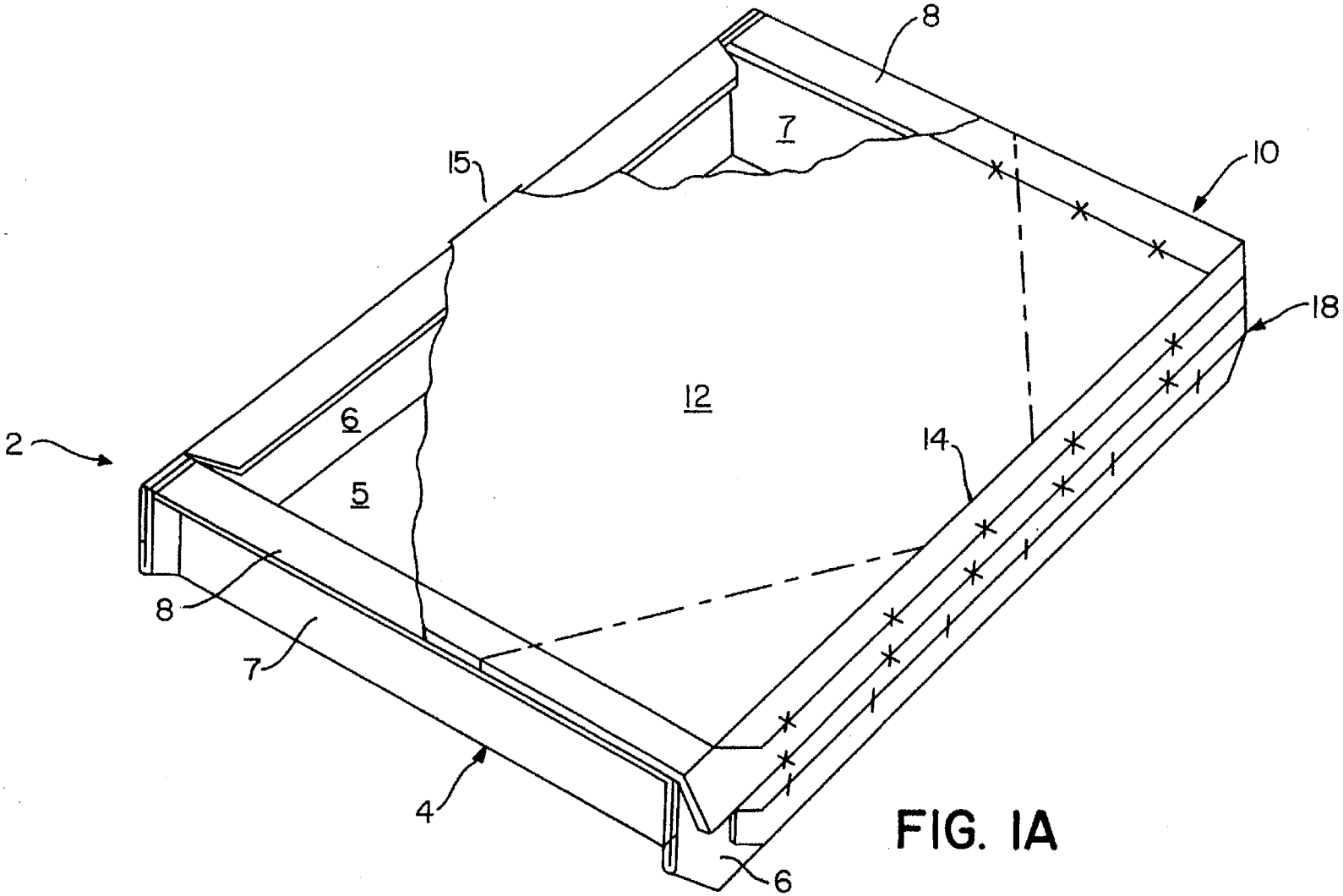
FIG. 1A is a perspective view of a package having a first embodiment of a tray cover, partially cut out, embodying the principles of the present invention.

A first embodiment of a package including a tray cover according to the present invention is generally indicated by reference number 2 in FIG. 1A. The package includes a tray 4 having a bottom panel 5 and a plurality of depending walls such as side wall panels 6 and end wall panels 7, which together define a container space. Suitable trays for use in the first embodiment of the present invention are disclosed and described in allowed U.S. patent application Ser. No. 08/119,656, filed Sep. 13, 1993, the disclosure of which is hereby incorporated by reference. The tray 4 is covered, so as to enclose the container space, by a tray cover 10.

Figure 1B:
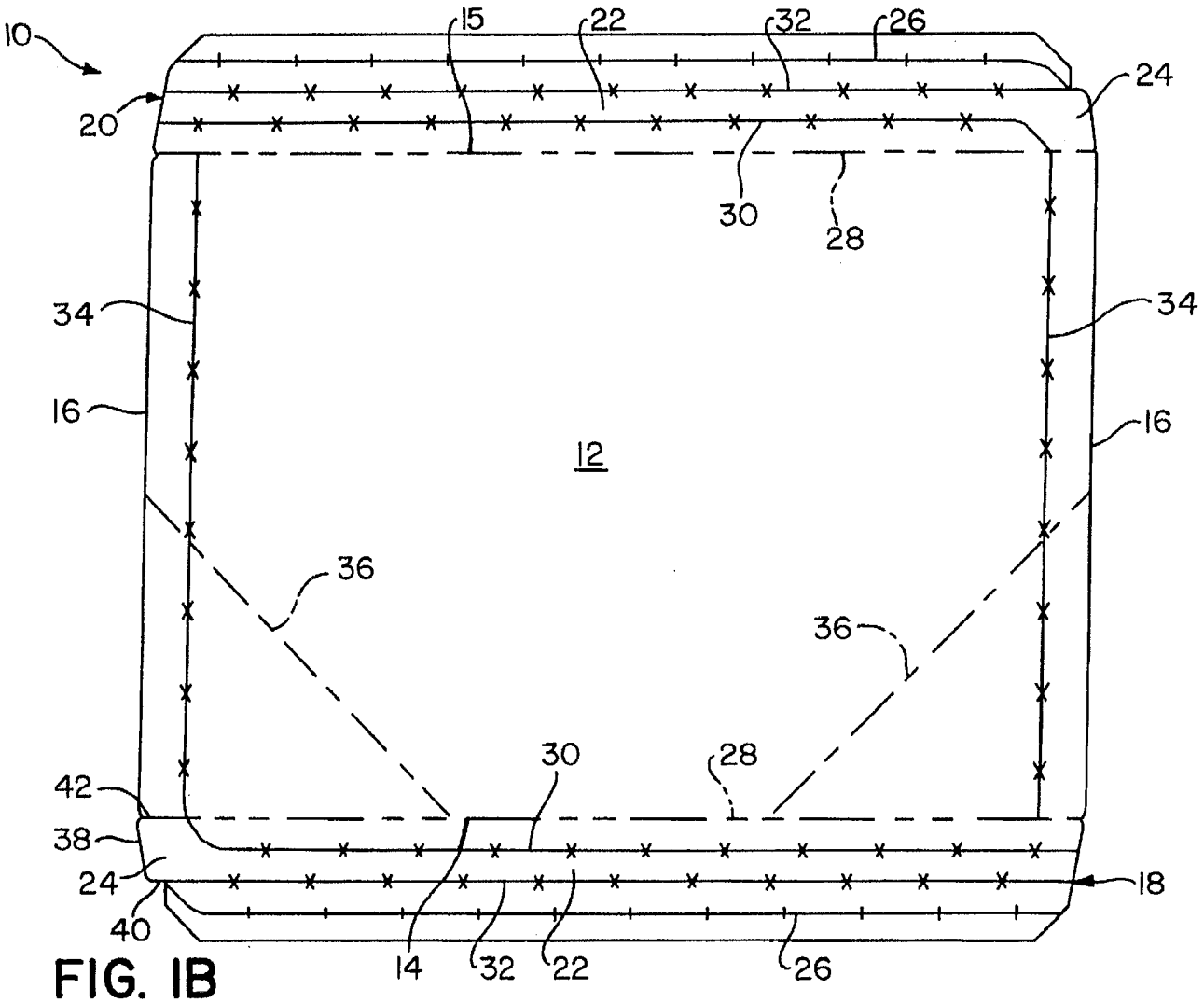
FIG. 1B is a plan view of a tray cover blank which is foldable into the tray cover according to the first embodiment.

A tray cover blank foldable into a tray cover in accordance with a first embodiment of the present invention is generally indicated by reference number 10 in FIG. 1B. The blank 10 is preferably formed of any suitable sheet material such as, for example, paperboard. It will be understood that the sheet material may be in the form of a laminate, such as a plastic film (e.g. polypropylene or PET), laminated to the paperboard. Preferably, the plastic film is on the interior of the paperboard blank although it may be provided on the exterior as well. The laminate may include, in selective portions throughout the paperboard material, a microwave susceptor material. The susceptor material may either be microwave-interactive or microwave-shielded material.

As shown in FIG. 1B, the tray cover blank 10 is suitably cut and/or scored to provide a lid wall panel 12 defined peripherally by two flap fold lines 14, 15 and two opposing free edges 16. The tray cover blank 10 also includes first and second flap panels 18 and 20 which are integral with the lid wall panel 12 along the flap fold lines 14, 15, respectively. The flap fold lines 14, 15 are preferably each a regular channel score as viewed from the side of the blank forming the exterior of the tray cover when erected.

In FIG. 1B and all other figures showing a plan view of a tray cover blank, the side shown will be an exterior surface of the tray cover blank. Continuous partial cut lines (50% cuts) cut into the exterior surface are shown by a continuous line with regularly spaced short perpendicular lines crossing the continuous line. Continuous cut lines cut into the interior surface are shown by continuous lines with small regularly spaced X's drawn across the line. Full channels scored into the exterior surface will be shown by a continuous line interrupted by periodic short single dashes. Aligned interrupted cuts formed in the exterior surface are indicated by a dashed line and aligned interrupted cuts formed in a full channel scored in the exterior surface will be indicated by a solid line interrupted by periodic short double dashes.

In accordance with the principles of the present invention, the flap panels 18, 20 are each provided with a removable strip portion 22, which can be manually removed to facilitate removal of a substantial portion of the lid wall panel 12 from the tray cover to expose the container space of the tray as will be described in more detail below.

Each removable strip portion 22 is defined by an interior score pattern and an exterior score pattern. The interior score pattern includes two continuous interior cut lines 30, 32, closely spaced and generally parallel to one another, cut partially into the thickness of the paperboard from the interior surface of the blank. The exterior score pattern is defined by a continuous exterior cut 26 penetrating partially into the thickness of the paperboard from the exterior surface and extending generally along the entire length of the flap panel 18 or 20 parallel to the flap fold line 14 or 15. The exterior score pattern is also defined by a line 28 that comprises a plurality of aligned interrupted cuts (short, repeating dashed cuts) penetrating partially into the thickness of the paperboard from the exterior surface. The lines 28 of interrupted partial cuts coincide with the flap fold lines 14, 15 along an extent of each flap fold line.

Each removable strip portion 22 is also provided with a grippable portion 24 defined by 100% through cuts 38, 40 and partial through cut 42 extending about three sides of the grippable portion 24. The grippable portion thus formed can be easily lifted from the tray surface and grasped by the user.

In accordance with the principles of the present invention, and as shown in FIG. 1A, the tray cover 10 is mounted in cooperating relation with the tray 4 to form a package containing consumable contents within the container space of the tray defined by the bottom panel 5 and a plurality of depending walls, such as side wall panels 6 and end wall panels 7. The resulting package functions as a tray suitable for retaining consumable contents therein so that the contents can be 1) heated in an oven while retained therein and 2) thereafter consumed while retained therein. The oven is preferably a microwave oven. In addition, when the tray cover is in a closed position with respect to the tray, the package serves as a storage container for the consumable contents.

The tray cover represented by the first embodiment in FIG. 1A is mounted on a tray 4 by joining structure which includes the flap panels 18, 20 folded about flap fold lines 14, 15, respectively, over each of opposing side wall panels 6 of the tray and fixed, such as by an adhesive, to the exterior surface of the opposing side wall panels of the tray. In addition to securing the tray cover to the tray, the flap panels, when folded to a position generally perpendicular to the lid wall panel, provide additional rigidity to the package beyond what is provided solely by the tray. The joining structure also includes a top flange portion 8 of the tray to which the lid wall panel 12 is secured along two surfaces of the lid wall panel 12 adjacent the edges 16.

Because the flap fold lines 14, 15 coincide with aligned interrupted cut lines 28, folding of the flaps 18, 20 about the intended fold lines 14, 15, as opposed to another line scored into the flaps, is ensured. In addition, because line 28 consists of interrupted cuts which are not 100% through cuts, the strength and integrity of the tray cover edge defined by the flap fold line are maintained.

The adhesive utilized for the first embodiment or any other embodiment may be of any type including either heat activated or pressure activated adhesives. The adhesive may be separately applied to the appropriate portions of the tray cover blank prior to or during mounting of the tray cover blank to the tray. Any suitable adhesive may be utilized, it being understood that where the tray cover material comprises a laminate including a plastic film on the interior surface of the paperboard, portions of the plastic itself may constitute the adhesive which is activated by heat preferably by directing a stream of hot air locally thereto just prior to mounting the tray cover blank to the tray.

Manual removal of the removable strip portion 22 from the tray cover 10 will now be described. The grippable portion 24 is grasped by a user and lifted away from the tray cover. Lifting the grippable portion away from the tray cover will cause the paperboard to delaminate along a delamination surface generally parallel to and between the interior and exterior surfaces. The paperboard will delaminate between the continuous interior cut line 32 and the continuous exterior cut line 26 and between the continuous interior cut line 30 and exterior cut line 28. As the user continues to pull the grippable portion away from the tray cover, the removable strip portion will progressively delaminate along a predetermined removal path defined by the interior partial cut lines 30, 32 and the exterior partial cut lines 26, 28.

To facilitate separation of a substantial portion of the lid wall panel 12 from the tray cover 10, two lid separation lines 34 are cut partially into the thickness from the interior surface. The lid separation lines 34 extend between the flap fold lines 14, 15 adjacent each of the free edges 16. Upon removal of the removable strip portions 22 from the flap panel 18 and the flap panel 20, a substantial portion of the lid wall panel 12 is removed by gripping an edge of the panel, now defined by former interior cut line 30, and lifting the lid wall panel 12 away from the tray cover 10. Lifting the lid wall panel 12 away from the tray cover 10 causes the paperboard to delaminate between each lid separation line 34 and each adjacent free edge 16.

Another feature of the first embodiment of the present invention is the provision of diagonal fold channels 36 to effect vent flaps to allow venting of the container space of the tray while heating the contents therein in an oven. Diagonal fold channels 36 are provided which extend from flap fold line 14 diagonally across a corner of the lid wall panel 12 to each of the free edges 16. The package is vented by manually removing the removable strip portion 22 of the flap panel 18, as is described above, and grasping an edge portion of lid wall panel 12 along former interior score line 30 near the corner of the lid wall panel 12 and lifting the corner of the lid wall panel to delaminate the lid wall panel along lid separation line 34 from flap fold line 14 to the point where line 36 intersects line 34. The corner of the lid wall panel is then folded over the diagonal fold line 36 to provide a vent opening.

Figure 2A:
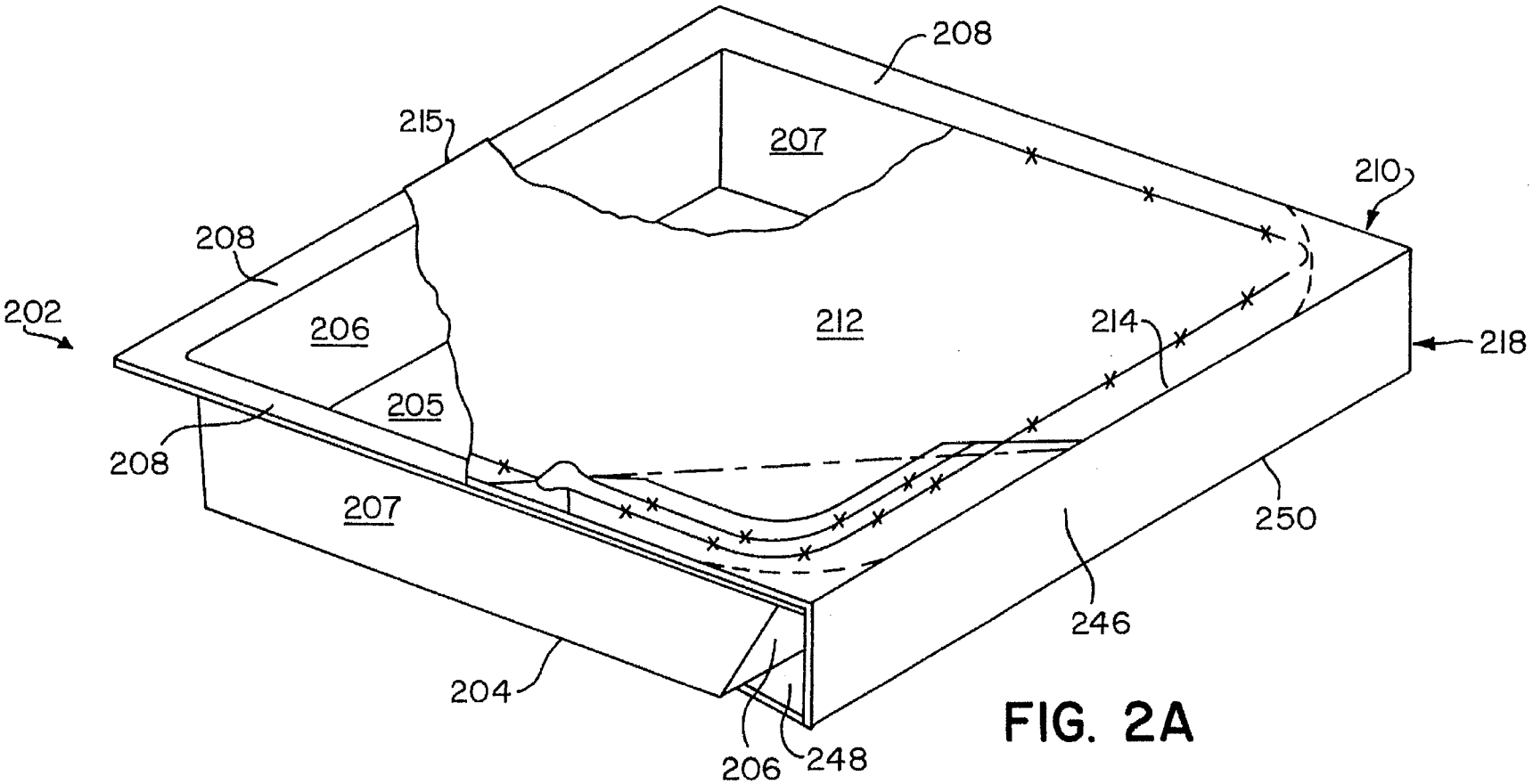
FIG. 2A is a perspective view of a package having a tray cover according to a second embodiment, partially cut out, embodying the principles of the present invention.

A second embodiment of a package including the tray cover according to the present invention is generally indicated by reference number 202 in FIG. 2A. The package includes a tray 204 having a bottom panel 205 and a plurality of depending walls, such as side wall panels 206 and end wall panels 207, which together define a container space. The tray would also preferably have a peripheral flange 208 oriented generally horizontally and extending around the periphery of the tray. The tray 204 is covered, so as to enclose the container space, by a tray cover 210. A suitable tray is disclosed in U.S. Pat. No. 5,090,615, the disclosure of which is hereby incorporated by reference.

Figure 2B:
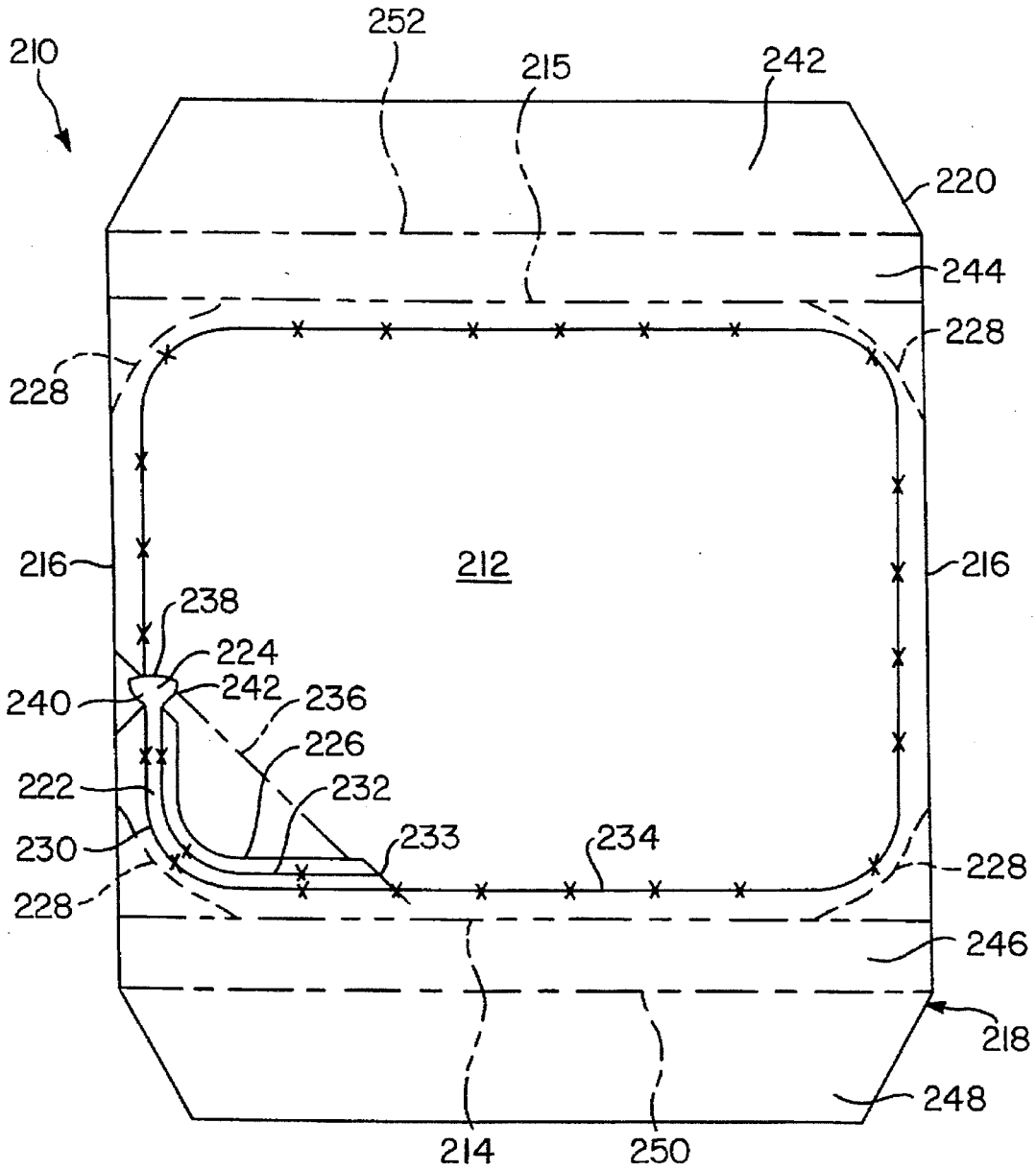
FIG. 2B is a plan view of a tray cover blank foldable into the tray cover according to the second embodiment.

A tray cover blank foldable into a tray cover in accordance with a second embodiment of the present invention is generally indicated by reference number 210 in FIG. 2B. The tray cover blank 210 is also formed of any suitable sheet material such as, for example, paper board and may be laminated.

As is shown in FIG. 2B, the tray cover blank 210 is suitably cut and/or scored to provide a lid wall panel 212 defined peripherally by two primary flap fold lines 214, 215 and two opposing free edges 216. The tray cover blank 210 also includes first and second flap panels 218, 220, which are integral with the lid wall panel 212 along the primary flap fold lines 214, 215, respectively. The flap panels 218, 220 include secondary flap fold lines 250, 252, respectively, which divide the first flap fold panel 218 into an edge flap 246 and a bottom flap 248, and divide the second flap panel 220 into an edge flap 244 and a bottom flap 242. The primary flap fold lines 214, 215 and the secondary flap fold lines 250, 252 are preferably each a regular channel score formed in the exterior of the tray cover blank.

In accordance with the principles of the present invention, and as shown in FIG. 2A, the tray cover 210 is mounted in cooperating relation with a tray 204 to form a package containing consumable contents within the container space of the tray defined by the bottom panel 205 and a plurality of depending walls, such as side wall panels 206 and end wall panels 207.

As shown in FIG. 2A, the tray cover of the second embodiment is mounted on a tray 204 by folding the flap panels 218, 220 about the primary flap fold lines 214, 215, respectively, over the edges of the peripheral flange 208 adjacent the opposing side wall panels 206. As can be seen in FIG. 2A, the edge flaps 246 and 244 (not shown) extend vertically adjacent a side of the tray 204 but do not contact the side wall panels 206 due to the outwardly extending flange 208. The bottom flaps 248 and 242 (not shown) are folded about the secondary flap fold lines 250 and 252 (not shown), respectively, to the bottom panel 205 of the tray 204. The bottom flaps 242, 248 are fixed to the bottom surface of the bottom panel 205 of the tray 204 by any suitable means, such as an adhesive. In addition, the lid wall panel 212 is fixed on its interior side about its periphery to the peripheral lip 208 by any suitable means, such as an adhesive to form a joining structure that joins the lid wall panel 212 to the side wall panels 206 and end wall panels 207.

In accordance with the principles of the present invention, the lid wall panel 212 is provided with a removable strip portion 222 which can be manually removed to facilitate separation of a substantial portion of the lid wall panel 212 from the tray cover to provide consuming access to the container space of the tray, as will be described in more detail below.

The removable strip portion 222 is defined by an interior score pattern and an exterior score pattern. The interior score pattern includes a first continuous interior cut line 230 penetrating partially into the thickness of the paper board from the interior surface of the tray cover blank. The continuous interior cut line 230 extends generally around one corner of the lid wall panel 212 to a termination line 233. The interior score pattern further includes a second continuous interior cut line 232 penetrating partially into the thickness of the paper board and closely spaced and generally parallel to the first continuous interior cut line 230. The second continuous interior cut line also extends around one corner of the lid wall panel 212 to the termination line 233. The termination line 233 is cut partially into the thickness of the paperboard from the exterior surface.

The exterior score pattern is defined by a continuous exterior cut line 226 cut partially into the thickness of the paper board from the exterior surface of the blank and disposed generally parallel to the second continuous interior cut line 232. The first continuous exterior cut line 226 extends to the termination line 233 generally along a path defined by the second interior continuous partial cut line 232. The exterior score pattern is further defined by a line 228 extending around each of the corners of the lid wall panel 212 and also extending coincidentally with a portion of each of the primary flap fold lines 214, 215. In the illustrated embodiment, the entirety of line 228 is shown as comprising plurality of aligned interrupted cuts (short, repeating cuts) extending partially into the thickness of the paper board from the exterior surface. It is to be noted, however, that it is necessary that line 228 comprise aligned interrupted cuts only for the extent of line 228 that is coincident with the primary flap fold lines 214, 215. The portions of line 228 that extend around each of the corners of the lid wall panel may comprise continuous partial cut lines.

The removable strip portion 222 is also provided with a grippable portion 224 defined by 100% through cuts 238, 240, 242 extending around three sides of the grippable portion 224.

The lid wall panel is also provided with a peripheral lid separation cut 234 that extends from the termination line 233, at the point where the first continuous interior cut line 230 terminates, around the periphery of the lid wall panel 212 and terminates at the grippable portion 224 as shown in FIG. 2B.

Manual separation of a substantial portion of the lid wall panel 212 to allow consuming access to the container space of the tray will now be described. The grippable portion 224 of the removable strip portion 222 is grasped by a user and lifted away from the tray cover. Lifting the grippable portion away from the tray cover will cause the paper board to delaminate along a delamination surface generally parallel to and between the interior and exterior surfaces. The paper board will delaminate between the continuous interior cut line 232 and the continuous exterior cut line 226 and between the continuous interior cut line 230 and cut line 228. As the user continues to pull the grippable portion away from the tray cover, the removable strip portion 222 will progressively delaminate along a predetermined removal path defined by the interior partial cut lines 230, 232 and the exterior partial cut lines 226, 228. The removable strip portion 222 will separate from the tray cover in the form of a strip extending around a corner of the lid wall panel 212 in a counterclockwise direction as viewed in FIG. 2B to the termination line 233. Thereafter, an exposed edge of the of the lid is grasped by the user and the lid portion is lifted away from the tray to cause delamination between peripheral lid separation cut 234 and line 228 and between peripheral lid separation cut 234 and the free edge 216. The predetermined removal path now becomes a lid removal path. By continuing to lift the exposed edge of the lid away from the tray, a substantial portion of the lid wall panel 212 will delaminate around its periphery to disengage the lid wall panel 212 from the flange 208 so that the lid wall panel may be separated from the tray.

Another feature of the second embodiment of the present invention is the provision of a diagonal fold channel 236 provided to effect a vent flap to allow venting of the container space of the tray while heating the contents therein in an oven. A diagonal fold channel 236 is provided which extends diagonally across the corner of the lid wall panel 212 from the continuous exterior cut line 226, adjacent the termination line 233, to the grippable portion 224. The package 202 is vented by delaminating the removable strip portion 222 up to the termination line 233. The corner of the lid wall panel 212 may then be folded over line 236 to effect a vent opening.

Figure 3:
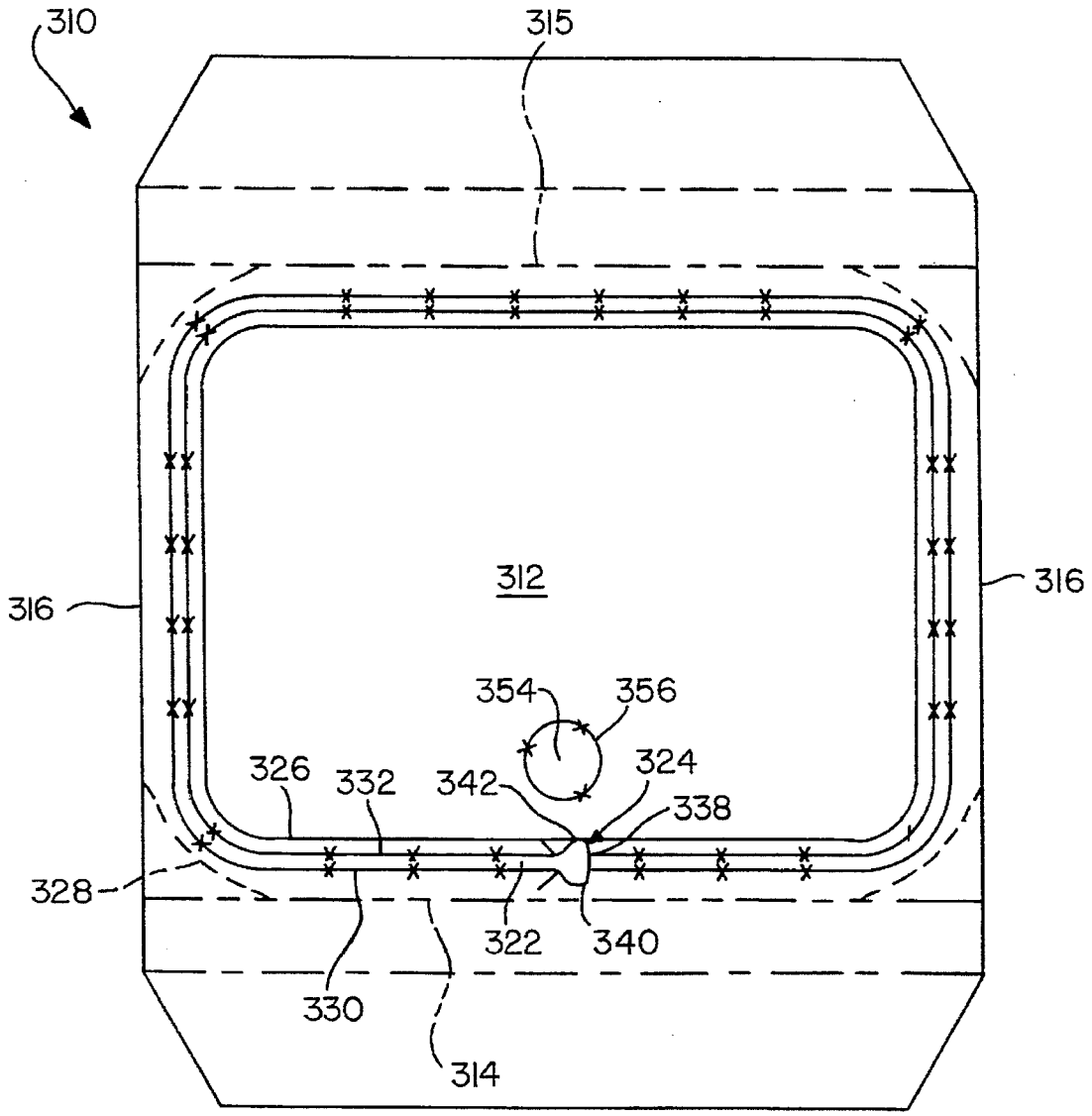
FIG. 3 is a plan view of a tray cover blank foldable into a tray cover according to a third embodiment.

A tray cover blank foldable into a tray cover in accordance with a third embodiment of the present invention is generally indicated by reference number 310 in FIG. 3. The tray cover blank 310 is also formed of any suitable sheet material such, for example, paper board, and may be laminated. As can be seen from FIG. 3, the tray cover blank 310 is in many respects similar to the tray cover blank of the second embodiment shown in FIG. 2B. In addition, tray cover blank 310 is mountable upon a tray (not shown) in much the same manner as is shown in FIG. 2A and described in the accompanying text.

The tray cover blank 310 is provided with a removable strip portion 322 defined by an interior score pattern and an exterior score pattern. The interior score pattern includes a first continuous interior cut line 330 penetrating partially into the thickness of the paper board from the interior surface of the tray cover blank. The first continuous interior partial cut line 330 extends generally around the entire periphery of the lid wall panel 312. The interior score pattern further includes a second continuous interior cut line 332, closely spaced and generally parallel to the first continuous interior cut line 330 and also extending generally around the entire periphery of lid wall panel 312.

The exterior score pattern is defined by a continuous exterior cut line 326 which extends generally around the entire periphery of the lid wall panel 312 and is generally parallel to the continuous interior cut lines 330, 332. The exterior score pattern is further defined by a line 328 extending around the corners of the lid wall panel 312 and also extending coincidentally with a portion of the primary flap fold lines 314, 315. In the illustrated embodiment, the entirety of line 328 is shown as comprising a plurality of aligned interrupted cuts (short, repeating cuts). It is to be noted, however, that it is necessary that line 328 comprise aligned interrupted cuts only for the extent of line 328 that is coincident with the primary flap fold lines 314, 315. The portions of line 328 that extend around each of the corners of the lid wall panel may comprise continuous partial cut lines.

The removable strip portion 322 is also provided with a grippable portion 324 defined by 100% through cuts 338, 340, 342 extending around three sides of the grippable portion 324.

The tray includes an intermediate wall that is of a double walled construction (not shown). At the top of the intermediate wall, the junction of the double wall structure provides a plateau surface that is generally horizontal and serves as a lid attachment surface.

The tray cover blank 310 is also provided with a back side attachment portion 354 defined by a back side partial cut score 356 that is a closed shape, such as a circle as shown in FIG. 3. The purpose of the back side attachment portion will be described in more detail below.

Manual removal of the removable strip portion 322 is initiated as with the previously described embodiments. By continuously lifting the removable strip portion away from the tray cover the removable strip portion progressively delaminates between continuous interior cut line 332 and continuous exterior cut line 326 and between continuous interior cut line 330 and continuous exterior cut line 328 or between continuous interior cut line 330 and free edge 316. Delamination progresses around the entire periphery of the lid wall panel 312 in a clockwise direction as viewed in FIG. 3.

The back side attachment portion 354 is fixed to the attachment surface of the intermediate wall (not shown) of the tray to form a portion of the joining structure. In all other respects, the tray cover blank 310 is mounted to a tray as is shown and described in reference to the second embodiment of the present invention in FIG. 2A. Due to attachment of the back side attachment portion 354 to the attachment portion of the tray, the lid wall panel 312 will remain in place even after the entire removable strip portion 322 has been removed from the periphery of the lid wall panel 312. This feature allows a substantial portion of the lid wall panel, defined by a central portion of the lid wall panel surrounded by the exterior line 326, to remain in place while the peripheral gap caused by removal of the removable strip portion 322 serves as a venting opening. Separation of the central portion of the lid wall panel 312 from the tray can be accomplished by grasping an edge of the central portion and lifting the central portion of the lid wall panel 312 away from the tray, thus, delaminating the back side attachment portion 354 at the back side partial cut score 356. Thus the partial cut score 356 acts as a lid separation cut.

Figure 4:
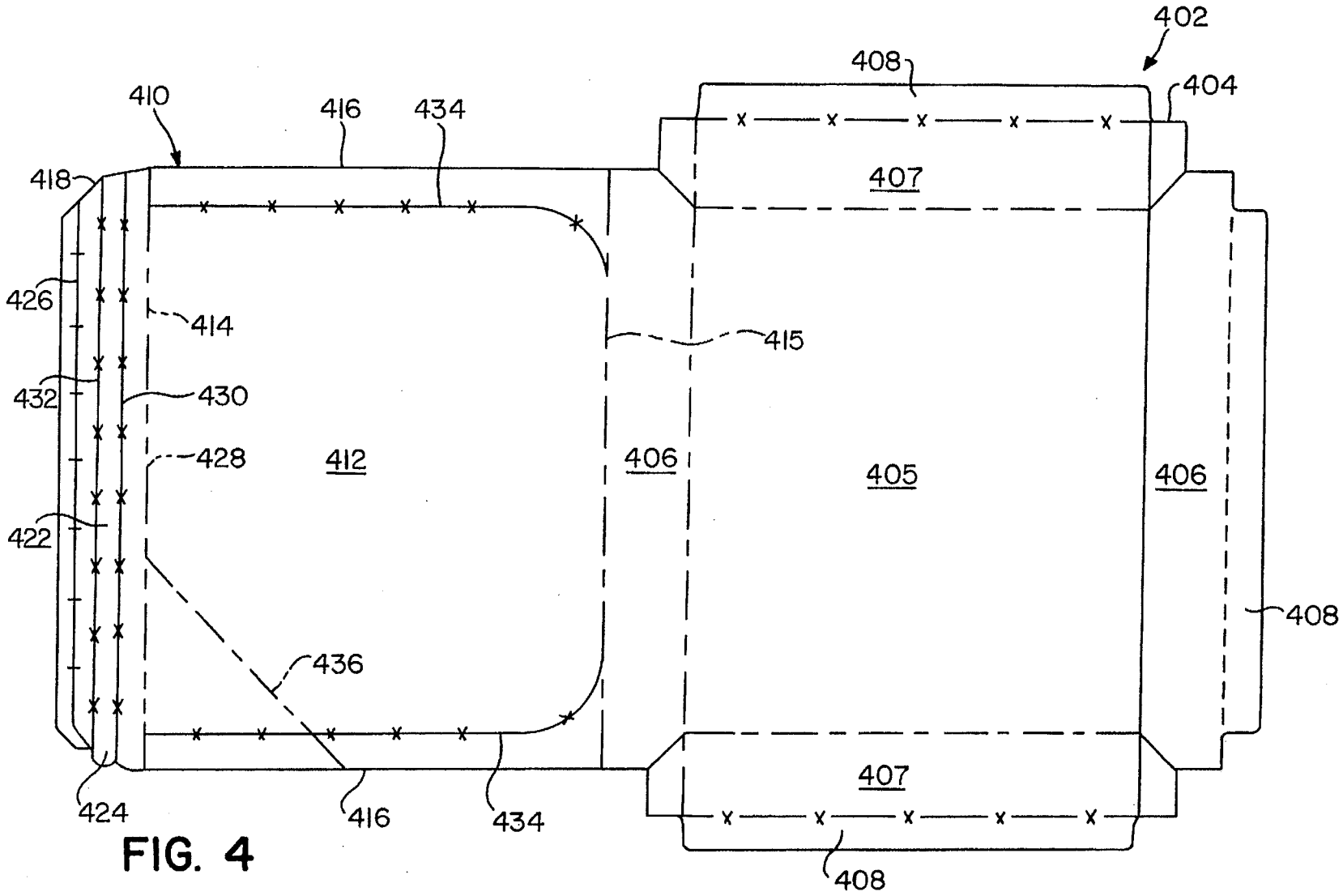
FIG. 4 is a plan view of a blank which is erectable into an integral tray and tray cover according to a fourth embodiment.

A blank foldable into an integral tray and tray cover in accordance with a fourth embodiment of the present invention is generally indicated by reference number 402 in FIG. 4. The tray portion of the blank 404 is comprised of surfaces which, upon erection of the tray become a bottom wall panel 405, side wall panels 406, and end wall panels 407. The tray portion of the blank is erectable as is described in U.S. Pat No. 5,183,201, the disclosure of which is hereby incorporated by reference. Alternatively, the tray portion could comprise a tray as disclosed in FIGS. 3 and 4 of U.S. Pat. No. 5,217,159, the disclosure of which is hereby incorporated by reference.

The tray cover portion 410 of the blank 402 is foldable over the tray portion 404 about lid fold line 415 and includes a flap panel 418 that is foldable about flap fold line 414. The lid fold line 415 and the flap fold line 414 are preferably channels scored into the foldable sheet material.

The tray is erected to provide flanges 408 to which the lid wall panel 412 is adhered at portions of the lid wall panel adjacent the edges 416 and the flap panel 418. The flap panel 418 is folded about flap fold line 414 over the side wall panel 406 and is adhered thereto. The flap panel 418 and the flange/lid wall panel interface effect a joining structure that holds the lid wall panel in a closed position with respect to the tray.

The flap panel 418 is provided with a removable strip portion 422 extending across its length. The removable strip portion 422 is defined by the closely spaced and generally parallel continuous interior cut lines 430, 432 and the exterior cut lines 426, 428. The exterior line 426 is a continuous cut line whereas the exterior line 428 comprises a plurality of aligned interrupted cuts extending coincidentally with the flap fold line 414. The removable strip portion 422 is also provided with a grippable portion 424.

The lid wall panel 412 is provided with lid separation cuts 434 to further facilitate separation of a substantial portion of the lid wall panel from the tray. After removal of the removable strip portion as is described above in reference to the previous embodiments, a substantial portion of the lid wall panel 412 may be separated from the tray by lifting an edge thereof and delaminating the periphery of the lid wall panel between the lid separation lines 434 and the edges 416. The blank of the fourth embodiment may also be provided with a diagonal fold channel 436 to allow the making of a vent opening as is described in connection with the first embodiment of the present invention (see FIG. 1B).

Figure 6:
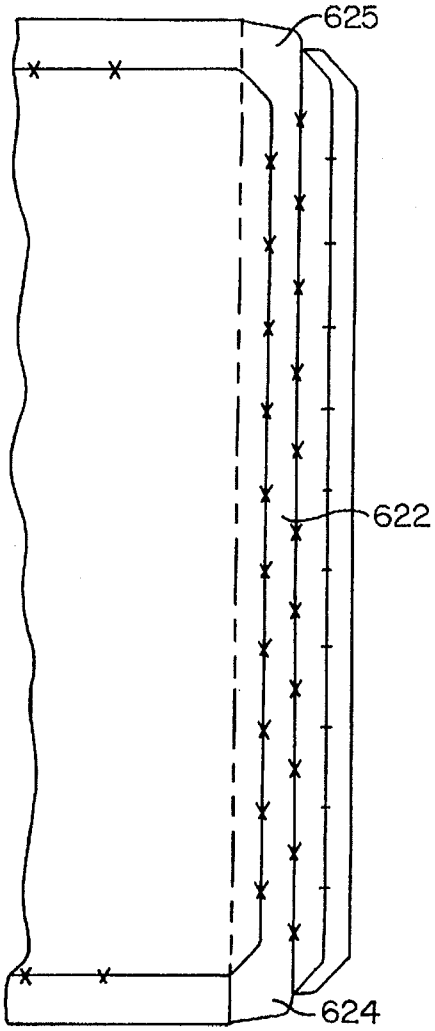
FIG. 6 is a partial plan view of a sixth embodiment of a blank which is erectable into a tray cover.
Figure 5:
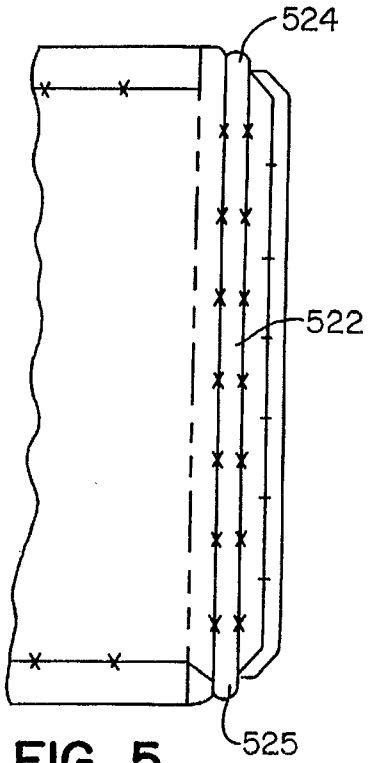
FIG. 5 is a partial plan view of a fifth embodiment of a blank which is erectable into a tray cover.

A removable strip portion constructed in accordance with the present invention may be removed from either direction. Therefore, the removable strip portion may be provided with a grippable portion at both ends thereof to facilitate use by both left and right handed users. As shown in FIG. 5, a fifth embodiment of the present invention is identical in all respects to the fourth embodiment shown in FIG. 4 except that in addition to the grippable portion 524 provided at one end of the removable strip portion 522, a grippable portion 525 is provided at the opposite end of the removable strip portion 522. As shown in FIG. 6, a sixth embodiment of the present invention is in all respects identical to the first embodiment of the present invention as shown in FIG. 1B except that in addition to the grippable portion 624 provided at one end of the removable strip portion 622, a second grippable portion 625 is provided at the opposite end of the removable strip portion 622.

Figure 7:
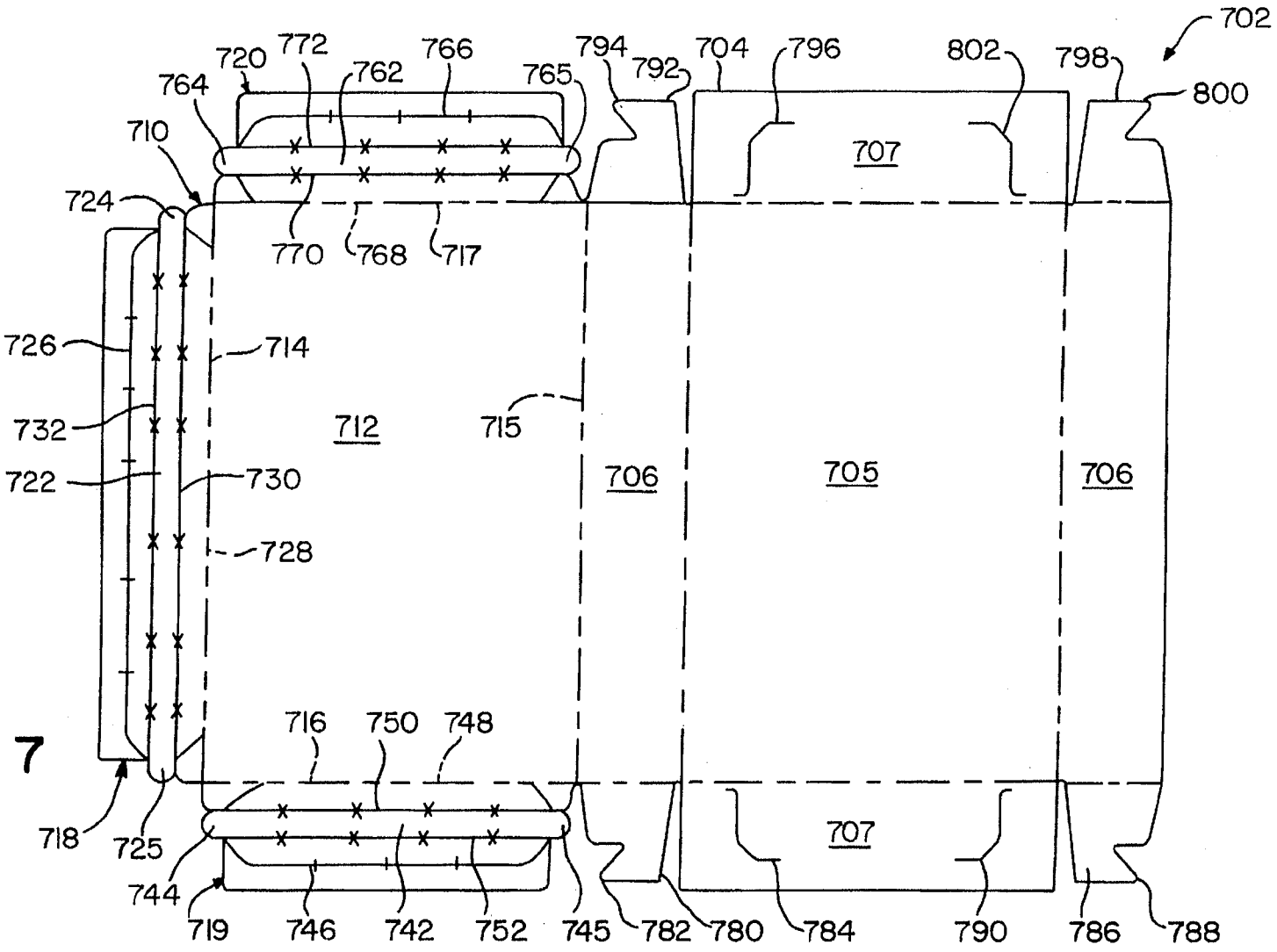
FIG. 7 is a plan view of a blank which is erectable into an integral tray and tray cover according to a seventh embodiment.

A blank foldable into an integral tray and tray cover in accordance with a seventh embodiment of the present invention is generally indicated by reference number 702 in FIG. 7. The tray portion of the blank 704 is comprised of surfaces which upon erection of the tray become a bottom wall panel 705, side wall panels 706, and end wall panels 707 and form a container space therebetween.

The corner construction of the tray 702 shown in FIG. 7 is a well known type of construction and includes corner tabs 780, 786, 792, 798, having tab hooks 782, 788, 794, 800, respectively. The tray 702 is erected by folding the side wall panels 706 and the end wall panels 707 up so as to be perpendicular to the bottom wall panel 705. The tab hooks 782, 788, 794, 800, are inserted into the slots 784, 790, 796, 802, respectively to lock the corners, and thus the side wall panels 706 and end wall panels 707, in place.

The corners could also be formed in the manner suggested in FIGS. 1 and 2 of previously mentioned U.S. Pat. No. 5,217,159.

The tray cover portion 710 of the blank 702 is foldable over the tray portion 704 about lid fold line 715 and also includes a first flap panel 718, foldable about first flap fold line 714, that has a first removable strip portion 722 extending across its length. The first flap panel 718 is disposed on an edge of the lid wall panel 712 opposed from the lid fold line 715. The first removable strip portion 722 is defined by the generally parallel continuous interior cut lines 730, 732 and the exterior cut lines 726, 728. The exterior line 726 is a continuous cut line whereas the exterior line 728 comprises a plurality of aligned interrupted cuts extending coincidentally with the first flap fold line 714.

The tray cover portion 710 of the blank 702 further includes second and third flap panels 719, 720 foldable about second and third flap fold lines 716 and 717, respectively. Second and third flap panels 719, 720 include second and third removable strip portions 742, 762, respectively. The second and third flap panels 719, 720 are disposed on edges of the lid wall panel 712 opposed from each other and perpendicular to the first flap fold line 714.

The second removable strip portion 742 is defined by the generally parallel continuous interior cut lines 750, 752 and the exterior cut lines 746, 748. The exterior line 746 is a continuous cut line whereas the exterior line 748 comprises a plurality of aligned interrupted cuts extending coincidentally with the second flap fold line 716. The third removable strip portion 762 is defined by the generally parallel continuous interior cut lines 770, 772 and the exterior cut lines 766, 768. The exterior line 766 is a continuous cut line whereas the exterior line 768 comprises a plurality of aligned interrupted cuts extending coincidentally with the third flap fold line 717.

The first removable strip portion 722 is provided with grippable portions 724, 725, the second removable strip portion 742 is provided with grippable portions 744, 745, and the third removable strip portion 762 is provided with grippable portions 764, 765. Although each removable strip portion 722, 742, 762 is shown with grippable portions on each end thereof, it is to be understood that each removable strip portion may be provided with only a single grippable portion at one end thereof.

The lid wall panel is secured closed with respect to the tray by folding the first flap wall panel over the side wall panel 706 and adhering the first flap wall panel to the side wall panel and folding the second and third flap wall panels over the end wall panels 707 and adhering the flap panels to the end wall panels.

After removal of the first, second, and third removable strip portions as is described above with reference to the fourth embodiment of FIG. 4, the lid wall panel 712 may be opened by lifting an edge thereof and folding or tearing it at the lid fold line 715 to allow access to the container space of the tray.

In the illustrated embodiments of FIGS. 1B, 4, 5, 6, and 7, in which the removable strip portion(s) is/are disposed on the flap panel(s), it is shown in each that the exterior score pattern includes a continuous exterior partial cut line as well as a line comprising a plurality of aligned interrupted cuts. It is noted, however, that for relatively small flap panels in which the distance from the flap fold line to an opposed edge of the flap is not great, the continuous exterior partial cut line may be dispensed with. The continuous exterior partial cut line is only necessary when the flap is of such a size that delamination in the area between the continuous interior cut line furthest disposed from the flap fold line and the edge of the flap is prevented.

Figure 9:
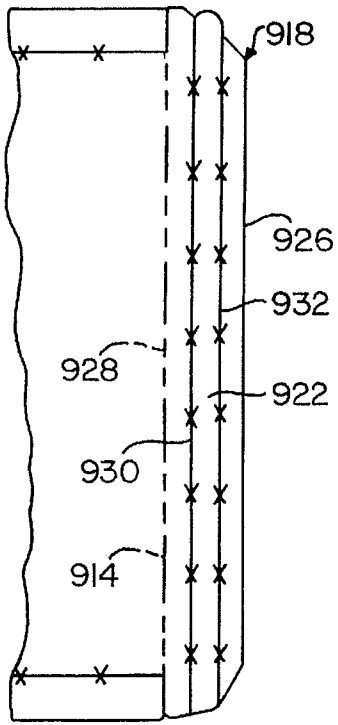
FIG. 9 is a partial plan view of a ninth embodiment of a blank which is erectable into a tray cover.
Figure 8:
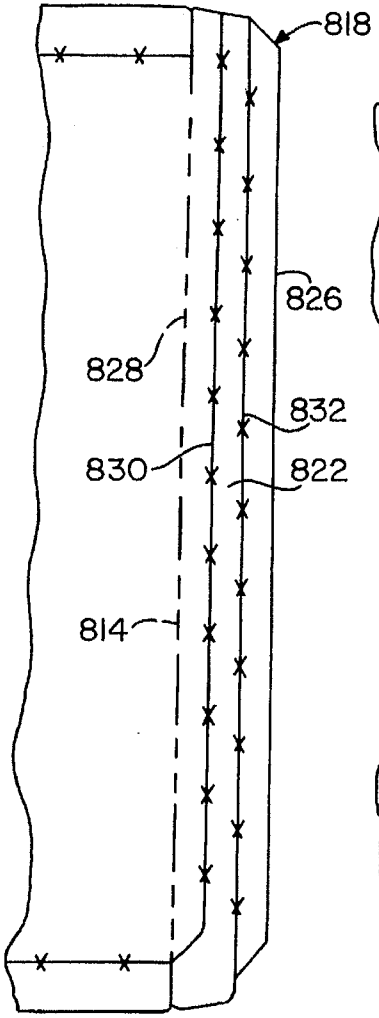
FIG. 8 is a partial plan view of an eighth embodiment of a blank which is erectable into a tray cover.

This alternate embodiment is illustrated in FIGS. 8 and 9. For example, as shown in FIG. 8, the interior score pattern of removable strip portion 822 includes closely spaced generally parallel continuous interior cut lines 830, 832. The exterior score pattern includes partial exterior cut line 828, which comprises a plurality of aligned interrupted partial cuts and coincides with flap fold line 814. The exterior score pattern further includes edge 826, of flap panel 818, opposed from flap fold line 814. When the removable strip portion 822 is pulled away from the tray cover, the foldable sheet material delaminates between cut lines 830 and 828 and between cut line 832 and edge 826.

Similarly, as shown in FIG. 9, the interior score pattern of removable strip portion 922 includes closely spaced generally parallel continuous interior cut lines 930, 932. The exterior score pattern includes partial exterior cut line 928, which comprises a plurality of aligned interrupted partial cuts and coincides with flap fold line 914. The exterior score pattern further includes edge 926, of flap panel 918, opposed from flap fold line 914. When removable strip portion 922 is pulled away from the tray cover, the foldable sheet material delaminates between cut lines 930 and 928 and between cut line 932 and edge 926.

Figure 10:
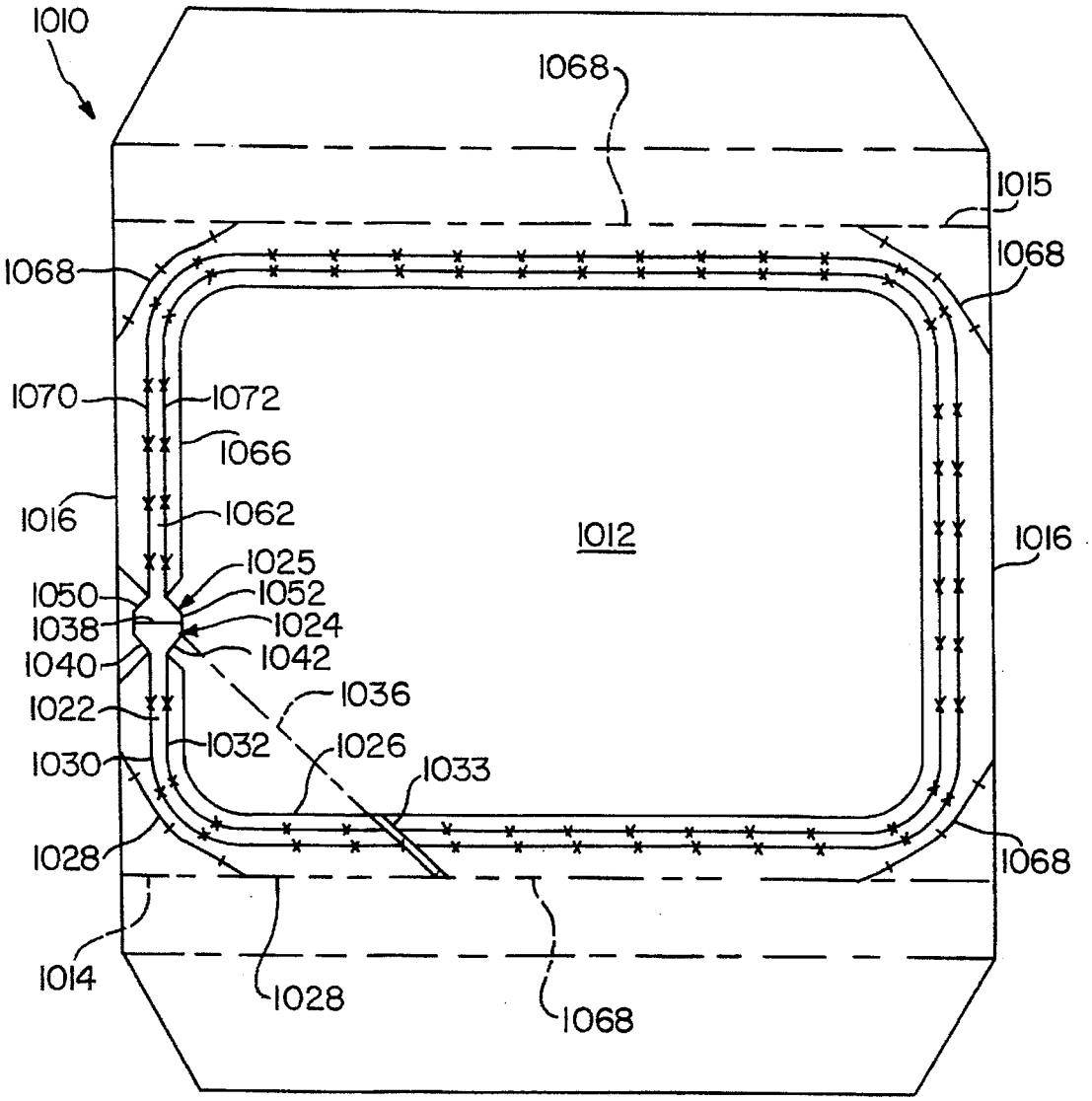
FIG. 10 is a plan view of a tray cover blank foldable into a tray cover according to a tenth embodiment.

A tray cover blank foldable into a tray cover in accordance with a tenth embodiment of the present invention is generally indicated by reference number 1010 in FIG. 10. The tray cover blank 1010 is also formed of any suitable sheet material such, for example, paper board, and may be laminated. As can be seen from FIG. 10, the tray cover blank 1010 is in many respects similar to the tray cover blanks of the second embodiment shown in FIG. 2B and the third embodiment shown in FIG. 3. In addition, tray cover blank 1010 is mountable upon a tray (not shown) in much the same manner as is shown in FIG. 2A and described in the accompanying text.

The tray cover blank 1010 is provided with a first removable strip portion 1022 defined by an interior score pattern and an exterior score pattern. The interior score pattern includes a first continuous interior cut line 1030 penetrating partially into the thickness of the paper board from the interior surface of the tray cover blank. The first continuous interior partial cut line 1030 extends around a first corner of the lid wall panel 1012 to a termination line 1033. The interior score pattern further includes a second continuous interior cut line 1032, closely spaced and generally parallel to the first continuous interior cut line 1030 and also extending around the first corner of lid wall panel 1012 to the termination line 1033.

The exterior score pattern is defined by a continuous exterior cut line 1026 which extends around the first corner of the lid wall panel 1012 and is generally parallel to the continuous interior cut lines 1030, 1032 and terminates at the termination line 1033. The exterior score pattern is further defined by a line 1028 extending around the first corner of the lid wall panel 1012 and also extending coincidentally with a portion of the first primary flap fold line 1014. Line 1028 comprises aligned interrupted cuts along the extent that is coincident with flap fold line 1014. The portion of line 1028 extending around the first corner is shown as a continuous partial cut line, but, as noted above, this portion of line 1028 may comprise either a continuous partial cut line or aligned interrupted cuts. Line 1028 terminates at the termination line 1033.

The termination line is preferably a scored channel or partial through cut extending from primary flap fold line 1014 to the continuous exterior cut line 1026.

The first removable strip portion 1022 is also provided with a grippable portion 1024 defined by 100% through cuts 1038, 1040, 1042 extending around three sides of the grippable portion 1024.

Tray cover blank 1010 further includes a second removable strip portion 1062. Second removable strip portion 1062 comprises an interior score pattern that includes two closely spaced generally parallel continuous partial interior cut lines 1070, 1072 extending around second, third, and fourth corners of the lid wall panel 1012 and terminating at termination line 1033.

Second removable strip portion 1062 further comprises an exterior score pattern which includes continuous partial exterior cut line 1066 generally parallel to interior cut lines 1070, 1072 which extends around the second, third, and fourth corners of the lid wall panel 1012 and terminates at the termination line 1033. The exterior score pattern also includes exterior line 1068 which extends around the second, third and fourth corners of the lid wall panel 1012 including an extent coincident with flap primary fold line 1015 and an extent coincident with primary flap fold line 1014. Line 1068 comprises aligned interrupted cuts along the extents that are coincident with primary flap fold lines 1014, 1015. The portion of line 1068 extending around the second, third, and fourth corners is shown as a continuous partial cut line, but, as noted above, this portion of line 1068 may comprise either a continuous partial cut line or aligned interrupted cuts. Line 1068 terminates at the termination line 1033.

The second removable strip portion 1062 is also provided with a grippable portion 1025 defined by 100% through cuts 1038, 1050, 1052 extending around three sides of the grippable portion 1025.

Finally, tray cover blank 1010 includes a diagonal vent score 1036 extending diagonally across the first corner from primary flap fold line 1014 at a point adjacent termination line 1033 to grippable portion 1024.

Manual removal of the first removable strip portion 1022 is initiated as with the previously described embodiments. By continuously lifting the first removable strip portion away from the tray cover, the removable strip portion progressively delaminates between continuous interior cut line 1032 and continuous exterior cut line 1026 and between continuous interior cut line 1030 and exterior cut line 1028 or between continuous interior cut line 1030 and free edge 1016. Delamination progresses around the first corner of the lid wall panel 1012 in a counter-clockwise direction as viewed in FIG. 10 to the termination line 1033. After the first removable strip portion as been removed up to the termination line, the first corner of the lid wall panel 1012 may be folded about diagonal vent score 1036 to effect a vent opening.

A substantial portion of the lid wall panel 1012 may be removed from the tray cover 1010 by next removing the second removable strip portion 1062, in the manner described above, around the second, third, and fourth corners of the lid wall panel 1012 in a clockwise direction as viewed in FIG. 10 to separate a substantial portion of the lid wall panel 1012 from the tray cover 1010.

Having described the invention, it will be apparent to those skilled in the art that various modifications may be made thereto without departing from the spirit and scope of this invention as defined in the appended claims.

What is claimed is:

1. A package suitable for retaining contents therein, said package comprising:

a tray having container space defined by a plurality of side wall panels and a bottom wall panel wherein said contents are contained; and a tray cover constructed of a foldable sheet material, having exterior and interior surfaces defining a thickness therebetween, constructed and arranged to provide a covering for said tray, said sheet material being constructed and arranged to delaminate along delamination surfaces generally parallel with said exterior and interior surfaces, said tray cover including a lid wall panel constructed and arranged so that in a closed position with respect to said tray said lid wall panel encloses said container space and a flap panel, integral with said lid wall panel, folded along a flap fold line over one of said side wall panels of said tray, said flap fold line comprising a channel scored into the foldable sheet material, said tray cover providing a removable strip portion constructed and arranged to be removed from said tray cover to facilitate separation of a substantial portion of said lid wall panel from said tray, said removable strip portion being defined on an exterior surface thereof by an exterior score pattern, and on an interior surface thereof by an interior score pattern, said removable strip portion being constructed and arranged to be removed by manually grasping a grippable portion thereof and pulling said removable strip portion away from said tray cover to progressively delaminate said sheet material between said interior and exterior score patterns along a predetermined removal path including an extent adjacent said flap fold line, said interior score pattern including continuous interior cut lines partially penetrating said thickness from said interior surface and disposed in a closely spaced generally parallel arrangement, said interior score pattern extending along said predetermined removal path to insure that delamination occurs along said predetermined removal path;

said exterior score pattern including exterior cuts partially penetrating said thickness from said exterior surface and extending along said predetermined removal path to insure that delamination occurs along said predetermined removal path, said exterior cuts including a plurality of aligned interrupted cuts disposed within said channel along at least a portion of said flap fold line to insure that the integrity of the exterior surface at the fold line is retained and to insure that the flap panel is folded about the flap fold line.

2. The package of claim 1 in which the tray cover is integral with the tray, said tray cover being foldable over said tray about a lid fold line.

3. The package of claim 2 wherein said first mentioned flap panel is disposed at an opposed edge of said lid wall panel from said lid fold line, said first mentioned removable strip portion is disposed on said flap panel, and said tray cover further includes second and third flap panels integral with said lid wall panel and disposed at opposed edges of said lid wall panel which are perpendicular to said first mentioned flap panel, said second and third flap panels each being foldable over one of said side wall panels about second and third flap fold lines, respectively, said second and third flap fold lines each comprising channels scored into the foldable sheet material, said second and third flap panels having second and third removable strip portions, respectively, disposed thereon, each of said second and third removable strip portions constructed and arranged to be removed from said second and third flap panels, respectively, to facilitate separation of said substantial portion of said lid wall panel from said tray, each of said second and third removable strip portions being defined on an exterior surface thereof by exterior score patterns, and on an interior surface thereof by interior score patterns, each of said second and third removable strips portion being constructed and arranged to be removed by manually grasping a grippable portion thereof and pulling each of said second and third removable strip portions away from each of said second and third flap panels, respectively, to progressively delaminate said sheet material between said interior and exterior score patterns along predetermined second and third removal paths including an extent adjacent each of said second and third flap fold lines respectively, said interior score patterns of each of said second and third removable strip portions including continuous interior cut lines partially penetrating said thickness from said interior surface and disposed in a closely spaced generally parallel arrangement, said interior score patterns extending along each of said second and third predetermined removal paths, respectively, to insure that delamination occurs along each of said second and third predetermined removal paths;

said exterior score patterns of each of said second and third removable strip portions including exterior cuts partially penetrating said thickness from said exterior surface and extending along each of said second and third predetermined removal paths, respectively, to insure that delamination occurs along each of said second and third predetermined removal paths, said exterior cuts including a plurality of aligned interrupted cuts disposed within said channel of each of said second and third flap fold lines to insure that the integrity of the exterior surface at each of said second and third flap fold lines is retained and to insure that each of said second and third flap panels is folded about each of said second and third flap fold lines, respectively, and wherein said substantial portion of said lid wall panel is separated from said tray by removing each of said first mentioned, second, and third removable strip portions from each of said first mentioned, second, and third flap panels, respectively, and lifting said substantial portion from said tray.

4. The package of claim 3 wherein said exterior score pattern of a one of said first mentioned, second, and third removable strip portions disposed on a corresponding one of said first mentioned, second, and third flap panels, respectively, which is folded about a corresponding one of said first mentioned, second, and third flap fold lines, respectively, includes an opposed edge of said corresponding one of said first mentioned, second, and third flap panel from said corresponding one of said first mentioned, second, and third flap fold lines.

5. A package suitable for retaining consumable contents therein so that said consumable contents can be (1) heated in an oven while retained therein and (2) thereafter consumed while retained therein, said package comprising:

a tray having container space defined by a plurality of side wall panels and a bottom wall panel wherein said consumable contents are contained;

a tray cover constructed of a foldable sheet material, having exterior and interior surfaces defining a thickness therebetween, constructed and arranged to provide a covering for said tray, said sheet material being constructed and arranged to delaminate along delamination surfaces generally parallel with said exterior and interior surfaces, said tray cover including a lid wall panel constructed and arranged so that in a closed position with respect to said tray said lid wall panel encloses said container space; and joining structure for joining said lid wall panel to said plurality of side walls to secure said lid wall panel in said closed position, said joining structure including a flap panel, integral with said lid wall panel, folded along a flap fold line over one of said side wall panels of said tray, said tray cover providing a removable strip portion constructed and arranged to be removed from said tray cover to disengage a portion of said joining structure to facilitate separation of a substantial portion of said lid wall panel from said tray, said removable strip portion being defined on an exterior surface thereof by exterior score patterns, and on an interior surface thereof by interior score patterns, said lid wall panel having separation cuts scored therein partially penetrating said thickness from said interior surface constructed and arranged to enable said substantial portion of said lid wall panel to be separable from said tray, after said removable strip portion has been removed, to permit consuming access to the heated consumable contents retained in said container space, said removable strip portion being constructed and arranged to be removed by manually grasping a grippable portion thereof and pulling said removable strip portion away from said tray cover to progressively delaminate said sheet material between said interior and exterior score patterns along a predetermined removal path including an extent adjacent said flap fold line, said interior score pattern including continuous interior cut lines partially penetrating said thickness from said interior surface and disposed in a closely spaced generally parallel arrangement, said interior score pattern extending along said predetermined removal path to insure that delamination occurs along said predetermined removal path;

said exterior score pattern including exterior cuts partially penetrating said thickness from said exterior surface and extending along said predetermined removal path to insure that delamination occurs along said predetermined removal path, said exterior cuts including a plurality of aligned interrupted cuts disposed along at least a portion of said flap fold line to insure that the integrity of the exterior surface at the fold line is retained and to insure that the flap panel is folded about the flap fold line.

6. The package of claim 5 wherein said removable strip portion is disposed on said lid wall panel.

7. The package of claim 5 wherein said removable strip portion is disposed on said flap panel.

8. The package of claim 7 wherein said exterior score pattern includes an opposed edge of said flap panel from said flap fold line.

9. The package of claim 7 in which said joining structure further includes:

a second flap panel integral with said lid wall panel disposed at an opposed edge of said lid wall panel from said first mentioned flap panel and folded along a second flap fold line over one of said side wall panels, said second flap fold line comprising a channel scored into the foldable sheet material, said second flap panel providing a second removable strip portion disposed thereon constructed and arranged to be removed from said second flap to further disengage a portion of said joining structure to facilitate separation of said substantial portion of said lid wall panel from said tray, said second removable strip portion being defined on an exterior surface thereof by an exterior score pattern, and on an interior surface thereof by an interior score pattern, said second removable strip portion being constructed and arranged to be removed by manually grasping a grippable portion thereof and pulling said removable strip portion away from said second flap panel to progressively delaminate said sheet material between said interior and exterior score patterns of said second removable strip portion along a second predetermined removal path including an extent adjacent said second flap fold line, said interior score pattern of said second removable strip portion including continuous interior cut lines partially penetrating said thickness from said interior surface and disposed in a closely spaced generally parallel arrangement, said interior score pattern of said second removable portion extending along said second predetermined removal path to insure that delamination occurs along said second predetermined removal path;

said exterior score pattern of said second removable strip portion including exterior cuts partially penetrating said thickness from said exterior surface and extending along said second predetermined removal path to insure that delamination occurs along said second predetermined removal path, said exterior cuts of said second removable strip portion including a plurality of aligned interrupted cuts disposed within said channel of said second flap fold line along at least a portion of said second flap fold line to insure that the integrity of the exterior surface at said second fold line is retained and to insure that said second flap panel is folded about the second flap fold line;

two free edges of said lid wall panel extending perpendicularly between said first mentioned and said second flap fold lines; and flanges extending substantially horizontally from said side wall panels for affixing said free edges of said lid wall panel thereto, said separation cuts including two edge cuts disposed adjacent an associated edge of said two free edges and constructed and arranged so that after said first mentioned and said second removable strip portions are removed, said substantial portion of said lid wall panel is separated from said tray by lifting said substantial portion away from said tray and delaminating said lid wall panel between each said edge cut and each said associated edge.

10. The package of claim 9 wherein said exterior score pattern of a one of said first mentioned and second removable strip portions disposed on a corresponding one of said first mentioned and second flap panels, respectively, which is folded about a corresponding one of said first mentioned and second flap fold lines, respectively, includes an opposed edge of said corresponding one of said first mentioned and second flap panels from said corresponding one of said first mentioned and second flap fold lines.

11. The package of claim 9 further including a venting score comprising a channel scored into said foldable sheet material of said lid wall panel and extending from said first mentioned flap fold line to one of said free edges of said lid wall panel, said venting score constructed and arranged so that after said first mentioned removable strip portion is removed, a portion of said lid wall panel is foldable about said venting score to effect a vent opening to said container space.

12. The package of claim 7 in which said removable strip portion is provided with a second grippable portion.

13. The package of claim 5 in which the tray cover is integral with the tray, said tray cover being foldable over said tray about a lid fold line.

14. The package of claim 13 in which said removable strip portion is provided with a second grippable portion.

15. The package of claim 13 wherein said flap panel is disposed at an opposed edge of said lid wall panel from said lid fold line, said removable strip portion is disposed on said flap panel, said joining structure includes two free edges of said lid wall panel extending perpendicularly between said flap fold line and said lid fold line and flanges extending substantially horizontally from said side wall panels for affixing said free edges of said lid wall panel thereto, and said separation cuts comprise a continuous lid separation cut disposed for an extent adjacent a first of said two free edges, then for an extent adjacent said lid fold line, and then for an extent adjacent a second of said two free edges, said continuous lid separation cut constructed and arranged so that after said removable strip portion is removed, said substantial portion of said lid wall panel is separated from said tray by lifting said substantial portion away from said tray to delaminate said lid wall panel between said continuous lid separation cut and said first free edge, said second free edge, and said lid fold line.

16. The package of claim 15 wherein said exterior score pattern includes an opposed edge of said flap panel from said flap fold line.

17. The package of claim 6 wherein said joining structure further includes:

a second flap panel integral with said lid wall panel disposed at an opposed edge of said lid wall panel from said first mentioned flap panel and folded along a second flap fold line over one of said side wall panels, said second flap fold line comprising a channel scored into the foldable sheet material; and horizontal flanges extending outwardly from both the side wall panels and the end wall panels to which the lid wall panel is attached at a peripheral portion thereof, said first mentioned and said second flap panels each being divided by a secondary flap fold line parallel to the first mentioned and second flap fold lines into an edge flap and a bottom flap, said edge flap of each of said first mentioned and said second flap panels effecting a vertical wall of the package when the first mentioned and second flap panels are folded about said first mentioned and said second flap fold lines, respectively, over said side wall panels of said tray, said bottom flap of each of said first mentioned and said second flap panels being foldable about said secondary flap fold lines of said first mentioned and said second flap panels under an exterior surface of said bottom wall panel and being attached thereto.

18. The package of claim 17 wherein said continuous interior cut lines of said interior score pattern extend from said grippable portion around a first corner of said lid wall panel and terminate at a termination line scored into the exterior surface of said lid wall panel and extending from said second flap fold line partially across said lid wall panel, said exterior cuts include a continuous exterior cut line extending from said grippable portion around said first corner of said lid wall panel and terminating at said termination line, and said plurality of aligned interrupted cuts are further disposed in said channel of said second flap fold line, said lid separation cuts comprise a continuous interior cut partially penetrating the thickness from said interior surface and extending from said termination line around second, third, and fourth corners of said lid wall panel and terminating at said grippable portion and wherein said substantial portion of said lid wall panel is separated from said tray by progressively delaminating said removable strip portion up to said termination line and then grasping an exposed edge of said lid wall panel proximate said first corner and lifting said exposed edge away from said tray cover to delaminate said lid wall panel between said lid separation cuts and said aligned interrupted cuts to disengage said lid wall panel from said flanges.

19. The package of claim 18 further including a venting score comprising a channel scored into said foldable sheet material of said lid wall panel and extending from said second flap fold line, proximate said termination line, diagonally across said first corner to said grippable portion, said venting score constructed and arranged so that after said removable strip portion is removed up to said termination line, said first corner of said lid wall panel is foldable about said venting score to effect a vent opening to said container space.

20. The package of claim 17 wherein said tray further includes an intermediate wall having a lid attachment surface, said continuous interior cut lines of said interior score pattern extend from said grippable portion around a periphery of said lid wall panel and terminate at said grippable portion, said exterior cuts include a continuous exterior cut line extending from said grippable portion around said periphery of said lid wall panel and terminating at said grippable portion, and said plurality of aligned interrupted cuts are further disposed in said channel of said second flap fold line, said joining structure further includes a lid attachment portion of said lid wall panel constructed and arranged to be adhered to said lid attachment surface of said intermediate wall, said lid separation cuts comprise a continuous interior cut partially penetrating the thickness from said interior surface and extending around said attachment portion of said lid wall panel, and wherein said substantial portion of said lid wall panel is separated from said tray by progressively delaminating said removable strip portion entirely around said periphery of said lid wall panel and then lifting said substantial portion of said lid wall panel to delaminate said attachment portion of said lid wall panel between said lid separation cuts.

21. The package of claim 17 wherein said continuous interior cut lines of said interior score pattern extend from said grippable portion around a first corner of said lid wall panel in a first direction and terminate at a termination line scored into the exterior surface of said lid wall panel and extending from said second flap fold line partially across said lid wall panel, said exterior cuts include a continuous exterior cut line extending from said grippable portion around said first corner of said lid wall panel in said first direction and terminating at said termination line, and said plurality of aligned interrupted cuts are further disposed in said channel of said second flap fold line, and said lid separation cuts comprise a second removable strip portion disposed on said lid wall panel and constructed and arranged to be removed from said lid wall panel to further disengaged a portion of said joining structure to facilitate separation of said substantial portion of said lid wall panel from said tray cover, said second removable strip portion being defined on an exterior surface thereof by exterior score patterns, and on an interior surface thereof by interior score patterns, said second removable strip portion being constructed and arranged to be removed by manually grasping a second grippable portion, disposed adjacent said first mentioned grippable portion, and pulling said removable strip portion away from said lid wall panel to progressively delaminate said sheet material between said interior and exterior score patterns of said second removable strip portion along a second predetermined removal path, including extents adjacent said first mentioned and second flap fold lines, said second predetermined removal path extending around second, third, and fourth corners of said lid wall panel in a second direction and terminating at said termination line, said interior score pattern of said second removable strip portion including continuous interior cut lines partially penetrating said thickness from said interior surface and disposed in a closely spaced generally parallel arrangement, said interior score pattern of said second removable portion extending along said second predetermined removal path to insure that delamination occurs along said second predetermined removal path, said exterior score pattern of said second removable strip portion including exterior cuts partially penetrating said thickness from said exterior surface and extending along said second predetermined removal path to insure that delamination occurs along said second predetermined removal path, said exterior cuts of said second removable strip portion including a plurality of aligned interrupted cuts disposed within said channel of said first mentioned flap fold line along at least a portion of said first mentioned flap fold line and within said channel of said second flap fold line along at least a portion of said second flap fold line to insure that the integrity of the exterior surface at said first mentioned and said second flap fold lines is retained and to insure that said first mentioned and said second flap panels are folded about the first mentioned and second flap fold lines, respectively, and wherein said substantial portion of said lid wall panel is separated from said tray by progressively delaminating said first removable strip portion in said first direction up to said termination line and then grasping said second grippable portion and lifting said second grippable portion to progressively delaminate said second removable strip portion from said tray cover up to said termination line to separate said lid wall panel from said tray cover.

22. The package of claim 21 further including a venting score comprising a channel scored into said foldable sheet material of said lid wall panel and extending from said second flap fold line, proximate said termination line, diagonally across said first corner to said first mentioned grippable portion, said venting score constructed and arranged so that after said first mentioned removable strip portion is removed from said tray cover up to said termination line, said first corner of said lid wall panel is foldable about said venting score to effect a vent opening to said container space.

* * * * *